US012565822B1

(12) United States Patent
Dindial et al.

(10) Patent No.: US 12,565,822 B1
(45) Date of Patent: Mar. 3, 2026

(54) MANAGEMENT OF DRILL STRING TEMPERATURES

(71) Applicant: Schlumberger Technology Corporation, Sugar Land, TX (US)

(72) Inventors: Deopaul Dindial, Al Khobar (SA); Ashers Partouche, Sugar Land, TX (US); Mikhail Charupa, Dhahran (SA); Ahmed Moge Ali, Dhahran (SA); Yan Fiona Li, Sugar Land, TX (US); Ahmed A. Rasool, Al-Khobar (SA)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/003,110

(22) Filed: Dec. 27, 2024

(51) Int. Cl.

| | |
|---|---|
| ***E21B 36/00*** | (2006.01) |
| ***E21B 47/017*** | (2012.01) |
| ***E21B 47/07*** | (2012.01) |
| ***E21B 49/00*** | (2006.01) |

(52) U.S. Cl.
CPC ..... *E21B 36/001* (2013.01); *E21B 47/0175* (2020.05); *E21B 47/07* (2020.05); *E21B 49/00* (2013.01)

(58) Field of Classification Search
CPC .... E21B 36/001; E21B 47/0175; E21B 47/07; E21B 49/00
See application file for complete search history.

(56) References Cited

U.S. PATENT DOCUMENTS

| | | | | |
|---|---|---|---|---|
| 12,264,576 | B2 * | 4/2025 | Al-Huwaider | E21B 47/0175 |
| 2011/0162847 | A1 * | 7/2011 | Martinez | E21B 36/001 166/77.2 |
| 2016/0076339 | A1 * | 3/2016 | Martin | E21B 47/017 166/57 |
| 2022/0154566 | A1 * | 5/2022 | Aidagulov | E21B 21/06 |
| 2023/0203945 | A1 * | 6/2023 | Proett | E21B 49/087 166/250.02 |
| 2025/0215768 | A1 * | 7/2025 | Reding | E21B 36/001 |

* cited by examiner

*Primary Examiner* — Nicole Coy
*Assistant Examiner* — Nicholas D Wlodarski
(74) *Attorney, Agent, or Firm* — Jeffrey D. Frantz

(57) ABSTRACT

Methods, systems, and computer readable storage mediums for managing downhole operations are disclosed. To manage downhole operations, the temperatures of various components of tools used in downhole environments may be taken into account. To preserve the life of the components of the tools, cooling flows may be used to retain temperatures of the components within operating ranges. By retaining the temperatures of the components within the operating ranges, the components may be less likely to become damaged, become impaired, and/or operate in undesired manners.

20 Claims, 11 Drawing Sheets

MANAGEMENT OF DRILL STRING TEMPERATURES

BACKGROUND

Geological formations may host a range of resources. For example, geological formations may include trapped liquids and/or gasses that may include hydrocarbons of various types. These hydrocarbons may be used for a variety of purposes.

The geological formations may also be used for other purposes. For example, undesired materials may be sequestered in the geological formations. Greenhouse gases such as carbon dioxide may be sequestered in geological formations to limit impacts of the greenhouse gases on the environment.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an aspect, a method of operating a tool string is provided. The method may include, while the tool string is being moved from a first position to a second position in a well: circulating a cooling flow to the tool string using a drill string and an annulus of the well; dividing, by the tool string, the cooling flow into a first sub-flow and a second sub-flow; ejecting the first sub-flow out of the tool string at a first location along the tool string to locally cool a region of the well; directing the second sub-flow internally through a portion of the tool string to a second location along the tool string to cool, at least, electronic components positioned in the portion of the tool string; and ejecting the second sub-flow out of the tool string at the second location along the tool string.

The first position may be above a target operating position in the well and the second position may be below the target operating position.

The method may also include, after reaching the second position: aligning the tool string with the target operating position; and while the tool string is aligned with the target operating position: initiating performance of a downhole operation using the tool string.

The method may further include, while the tool string is aligned with the target operating position: during the performance of the downhole operation: monitoring a temperature of at least the electronic components; and in an instance of the monitoring of the temperature where the temperature exceeds a threshold temperature: modifying a flow rate of the cooling flow to manage the temperature of the at least the electronic components within temperature limits, the threshold temperature being based on the temperature limits.

The temperature limits may be based on hardware components of the electronic components. The hardware components may be subject to damage and/or undesired operation when exposed to temperatures outside of the temperature limits.

Initiating the performance of the downhole operation may reduce a flow rate of the cooling flow.

The tool string may be aligned by, at least in part, raising the tool string from the second position and into the region of the well.

The downhole operation may include one selected from a group of downhole operations consisting of: interrogating a geological formation proximate to the region of the well to obtain information usable to identify properties of the geological formation and/or materials positioned with the geological formation; extraction of at least a portion of the materials positioned with the geological formation; and injection of another material into the geological formation.

The cooling flow may be circulated by, at least in part, pumping a material from a top side facility, through the drill string to the tool string, out of the tool string, and back to the top side facility.

Directing the second sub-flow internally through the portion of the tool string to the second location along the tool string to cool, at least, electronic components positioned in the portion of the tool string may be accomplished by, at least in part, pumping, by the tool string, the second sub-flow through at least a flowline to a port in that is in selective fluid communication with the annulus.

In an aspect, a system is provided. The system may include a processor and a memory. The memory may be coupled to the processor, and may store instructions, which when executed by the processor, cause operations for operating a tool string to be performed. The operations may include, while the tool string is being moved from a first position to a second position in a well: circulating a cooling flow to the tool string using a drill string and an annulus of the well; dividing, by the tool string, the cooling flow into a first sub-flow and a second sub-flow; ejecting the first sub-flow out of the tool string at a first location along the tool string to locally cool a region of the well; directing the second sub-flow internally through a portion of the tool string to a second location along the tool string to cool, at least, electronic components positioned in the portion of the tool string; and ejecting the second sub-flow out of the tool string at the second location along the tool string.

The first position may be above a target operating position in the well and the second position may be below the target operating position.

The operations may also include, after reaching the second position: aligning the tool string with the target operating position; and while the tool string is aligned with the target operating position: initiating performance of a downhole operation using the tool string.

The operations may also include: while the tool string is aligned with the target operating position: during the performance of the downhole operation: monitoring a temperature of at least the electronic components; and in an instance of the monitoring of the temperature where the temperature exceeds a threshold temperature: modifying a flow rate of the cooling flow to manage the temperature of the at least the electronic components within temperature limits, the threshold temperature being based on the temperature limits.

The temperature limits may be based on hardware components of the electronic components. The hardware components may be subject to damage and/or undesired operation when exposed to temperatures outside of the temperature limits.

Initiating the performance of the downhole operation may reduce a flow rate of the cooling flow.

Aligning the tool string may be accomplished by, at least in part, raising the tool string from the second position and into the region of the well.

The downhole operation may include one selected from a group of downhole operations consisting of: interrogating a geological formation proximate to the region of the well to obtain information usable to identify properties of the geological formation and/or materials positioned with the geological formation; extraction of at least a portion of the materials positioned with the geological formation; and injection of another material into the geological formation.

Circulating the cooling flow may include pumping a material from a top side facility, through the drill string to the tool string, out of the tool string, and back to the top side facility.

In an aspect, a non-transitory machine-readable medium is provided. The non-transitory machine-readable medium may have instructions stored therein, which when executed by a processor, cause operations for operating a tool string to be performed. The operations may include, while the tool string is being moved from a first position to a second position in a well: circulating a cooling flow to the tool string using a drill string and an annulus of the well; dividing, by the tool string, the cooling flow into a first sub-flow and a second sub-flow; ejecting the first sub-flow out of the tool string at a first location along the tool string to locally cool a region of the well; directing the second sub-flow internally through a portion of the tool string to a second location along the tool string to cool, at least, electronic components positioned in the portion of the tool string; and ejecting the second sub-flow out of the tool string at the second location along the tool string.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Embodiments disclosed herein are illustrated by way of example and not limitation in the figures of the accompanying drawings in which like references indicate similar elements.

DETAILED DESCRIPTION

Various embodiments will be described with reference to details discussed below, and the accompanying drawings will illustrate the various embodiments. The following description and drawings are illustrative and are not to be construed as limiting. Numerous specific details are described to provide a thorough understanding of various embodiments. However, in certain instances, well-known or conventional details are not described in order to provide a concise discussion of embodiments disclosed herein.

Reference in the specification to "one embodiment" or "an embodiment" means that a particular feature, structure, or characteristic described in conjunction with the embodiment can be included in at least one embodiment. The appearances of the phrases "in one embodiment" and "an embodiment" in various places in the specification do not necessarily all refer to the same embodiment.

Geological formations may be exploited to obtain various energy resources (e.g., hydrocarbons entrained in fluids/gases), to sequester undesired materials, and/or for other purposes. To exploit a geological formation, the properties (e.g., physical structure, thermal, etc.) of the geological formation may be characterized, tools may be positioned in wells positioned with the geological formation, and/or various downhole operations may be performed.

Figure 1:
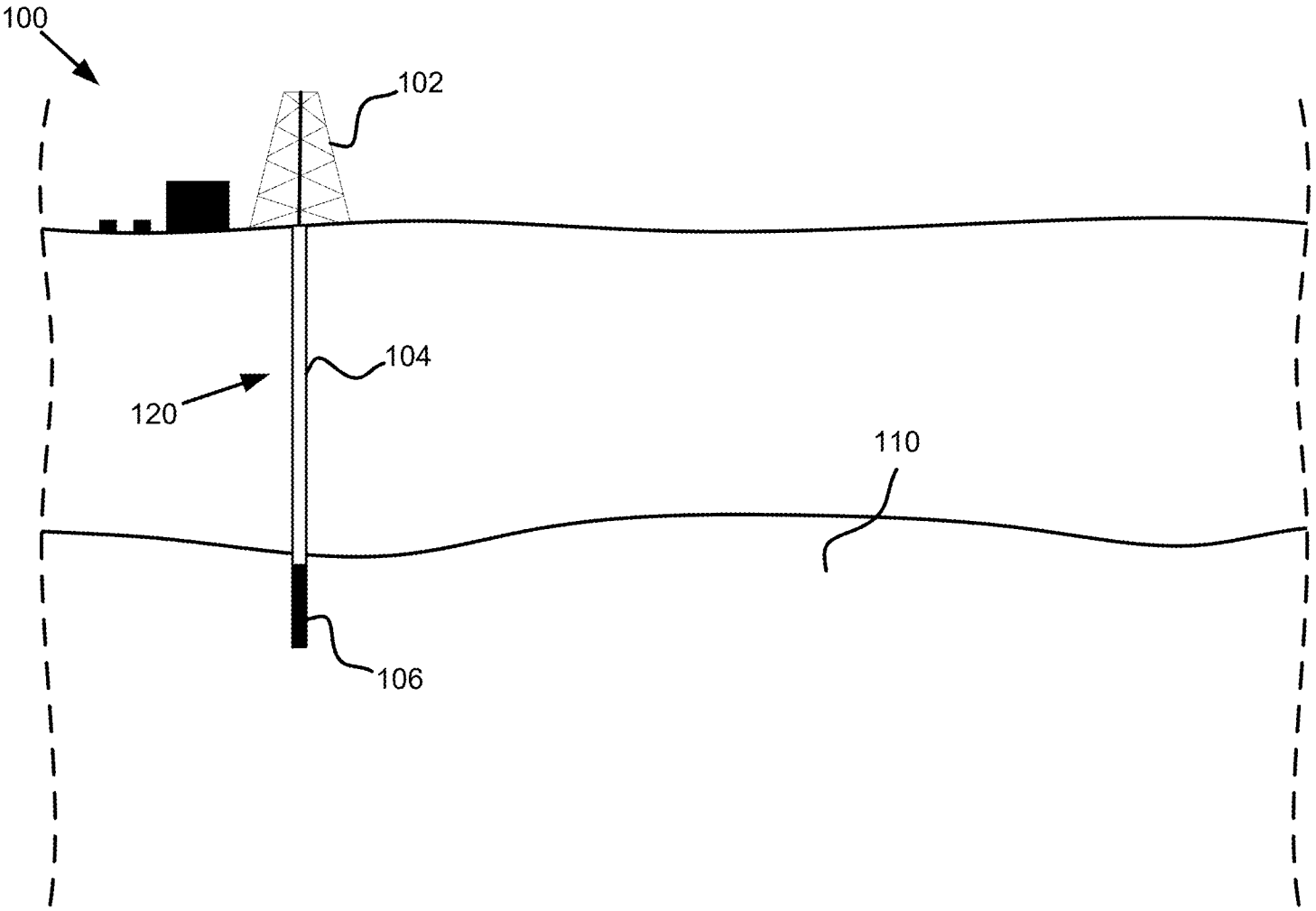
FIG. 1 shows a diagram illustrating a system in accordance with an embodiment.

Turning to FIG. 1, a diagram of geological formation 110 in accordance with an embodiment is shown. Geological formation 110 may be a portion of the Earth's crust. In FIG. 1, geological formation 110 is illustrated as being positioned on land. However, it will be appreciated that embodiments disclosed herein may be used with respect to geological formations positioned below oceans or other bodies of water.

Geological formation 110 may be usable, for example, to sequester undesired materials (e.g., greenhouse gasses), produce energy resources (e.g., hydrocarbons), and/or for other purposes. To exploit geological formation 110, a well 120 may be drilled to provide for physical access to geological formation 110. In this manner, materials may be removed from and/or added to geological formation 110.

To exploit and/or decide how to exploit geological formation 110, information regarding the properties of geological formation 110 (and/or materials entrained therein) may be collected and/or various downhole operations may be performed. To do so, a tool 100 may be used. The tool may include any of surface facility 102, drill string 104, bottom hole assembly 106, and/or components not illustrated in FIG. 1.

Surface facility 102 may be a facility positioned above and/or near geological formation 110. While drawn in FIG. 1 as being positioned on land and including a derrick, surface facility 102 may include a water born vessel such as a drill ship or other type of sea going vessel (e.g., a platform) without departing from embodiments disclosed herein.

Surface facility 102 may include, for example, (i) control systems for other components such as bottom hole assembly 106, (ii) materials (e.g., drilling mud, water, gasses such as carbon dioxide) usable to form well 120, operate well 120, and characterize well 120/geological formation 110, (iii) various assemblies and/or components usable with other assemblies, (iv) drill pipe and/or other components for well development such as fluid flow chillers, (v) completion components such as cement for completion of well 120, (vi) power systems, (vii) storage tanks for various materials used in well construction, and/or other materials, systems, etc. for well development.

Drill string 104 may include (i) any number of sections of drill pipe, (ii) wirelines usable to send control signals and/or power to downhole components, (iii) fluid lines and/or other lines for moving of fluids between bottom hole assembly 106 and/or surface facility 102, and/or other components usable as part of a drill string. Drill string 104 may connect bottom hole assembly 106 to surface facility 102, and may divide the wellbore into an annulus (e.g., area between outside of drill pipe/components and wellbore walls/casing).

Figure 2A:
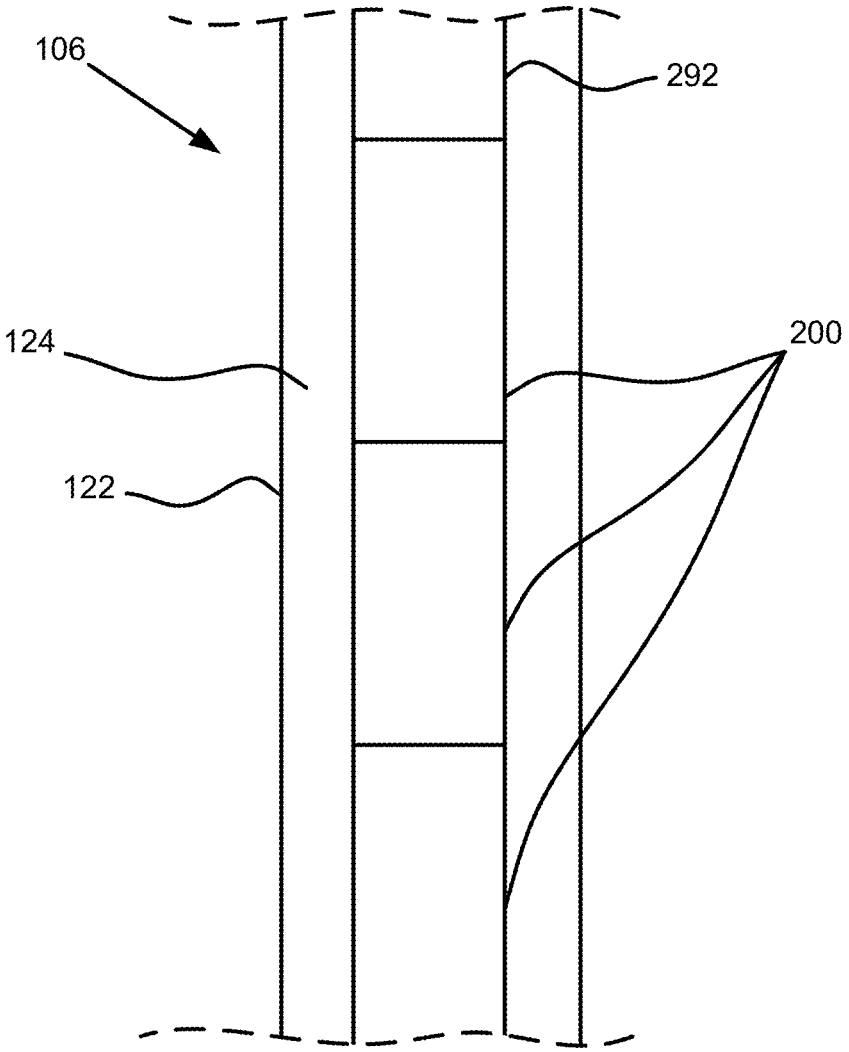
FIG. 2A shows a diagram illustrating a bottom hole assembly in accordance with an embodiment.

Bottom hole assembly 106 may provide for, in addition to other functions, performance of various tests on well 120 and/or geological formation 110 proximate to well 120, sampling of materials from geological formation 110, and/or injection of materials into geological formation 110. Refer to FIG. 2A for additional details regarding bottom hole assembly 106.

In general, embodiments disclosed herein relate to methods and systems for completing wells, obtaining information to aid in the modeling of geological formations, obtaining information usable to grade or characterize wells and/or geological formations for various uses, production and/or sampling of materials from geological formations, and/or injection of materials into geological formations. To obtain information regarding wells and geological formations, after wellbores are drilled, various intervals (e.g., portions of a well) along the wellbores and/or proximate portions of geological formation may be characterized using various types of testing (e.g., samples of materials).

An interval may be an isolated portion of the wellbore (e.g., isolated using packers or other space filling components). The testing may include, for example, sampling of materials from an interval (e.g., for additional analysis, the sampled material may be returned to the surface for additional analysis), dynamic testing such as transient testing, and/or other types of testing.

For example, transient testing may be performed by (i) isolating an interval, (ii) attempting to pump (and/or allow to flow due to existing pressure) fluids and/or gasses into and/or out of the intervals, (iii) measuring flow properties (e.g., fall off rates) during the pumping of the fluids and/or the gasses, (iv) using the measured flow properties to model and/or grade the interval with respect to one or more potential uses (e.g., such as material sequestration), and/or other actions usable to obtain information usable to guide well development.

The model and/or grade (e.g., for any number of intervals) may be used to establish a completion plan (e.g., may define components for installation, location of the installations, etc.) for the well and/or exploitation plan (e.g., how to operate a completed well, and/or guide completion of the well to improve yield for various purposes) for the geological formation. The plans may be obtained in an automated (e.g., computer defined), semiautomated (e.g., computer guided with subject matter expert review/feedback), and/or manual (e.g., subject matter expert defined) manner using various test results.

Once obtained, the wells may then be completed and the geological formation may be exploited using the plans. Thus, the resulting wells and corresponding exploitation of the geological formation may be more likely to be desirable by virtue of the testing information used in the formulation of the plans.

For example, the testing may be used to identify portions of the geological formation that are better able to sequester various materials, better able to produce hydrocarbons, etc. Accordingly, a completion plan may, for example, be established with injection/extraction sites along the wellbore at these identified portions of the geological formation.

To perform the testing and/or other downhole operations, various electronic components of bottom hole assembly 106 may perform various actions. However, the electronic components (and/or other types of components) of bottom hole assembly 106 may have limited operating temperature ranges. If the temperature of the electronic components falls outside of the limited operating temperature ranges, then the electronic components may (i) not operate as expected, (ii) may operate in an impaired manner, and/or (iii) may fail to operate. Any of these conditions may limit, impair, and/or prevent desired downhole operations from being performed successfully.

For example, some of the electronic components may be relays. If the temperatures of the relays fall outside of corresponding operating temperature ranges, then the relays may fail to open or close electrical circuits when instructed to do so (e.g., via wireline transmitted signals to bottom hole assembly 106 from surface facility 102). Consequently, various modules and/or other components of bottom hole assembly 106 may become uncontrollable thereby rendering bottom hole assembly 106 unable to complete desired downhole operations.

The temperatures of the electronic components and/or other components of bottom hole assembly 106 may be impacted by ambient temperatures in well 120. For example, thermal energy from geological formation 110 may raise the ambient temperature in various sections of well 120 to undesirably high levels. This elevated temperature may, in turn, cause the temperatures of the components of bottom hole assembly 106 to fall outside of corresponding operating ranges.

Figure 2B:
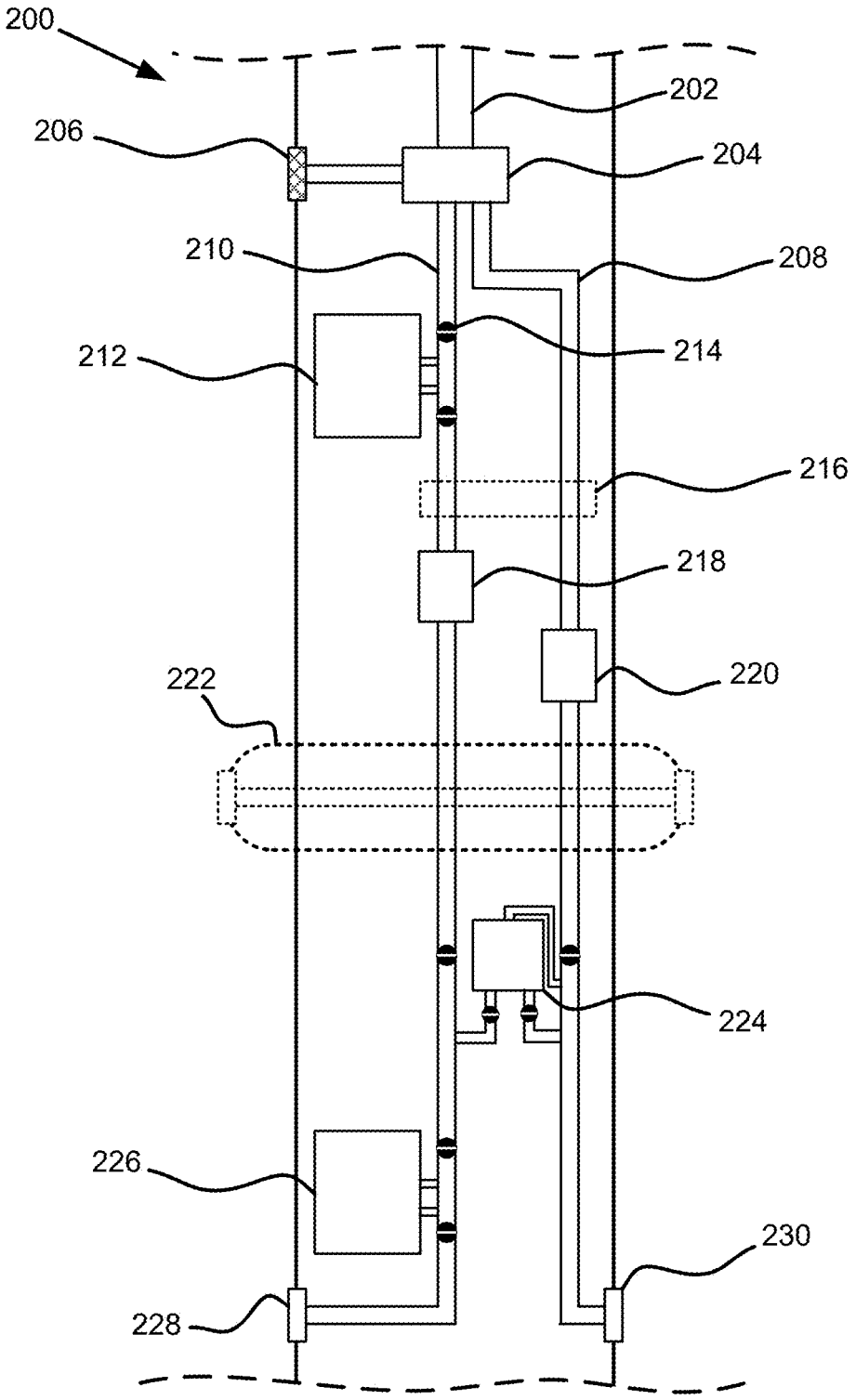
FIGS. 2B-2C show diagrams illustrating portions of tool assemblies in accordance with an embodiment.
Figure 2C:
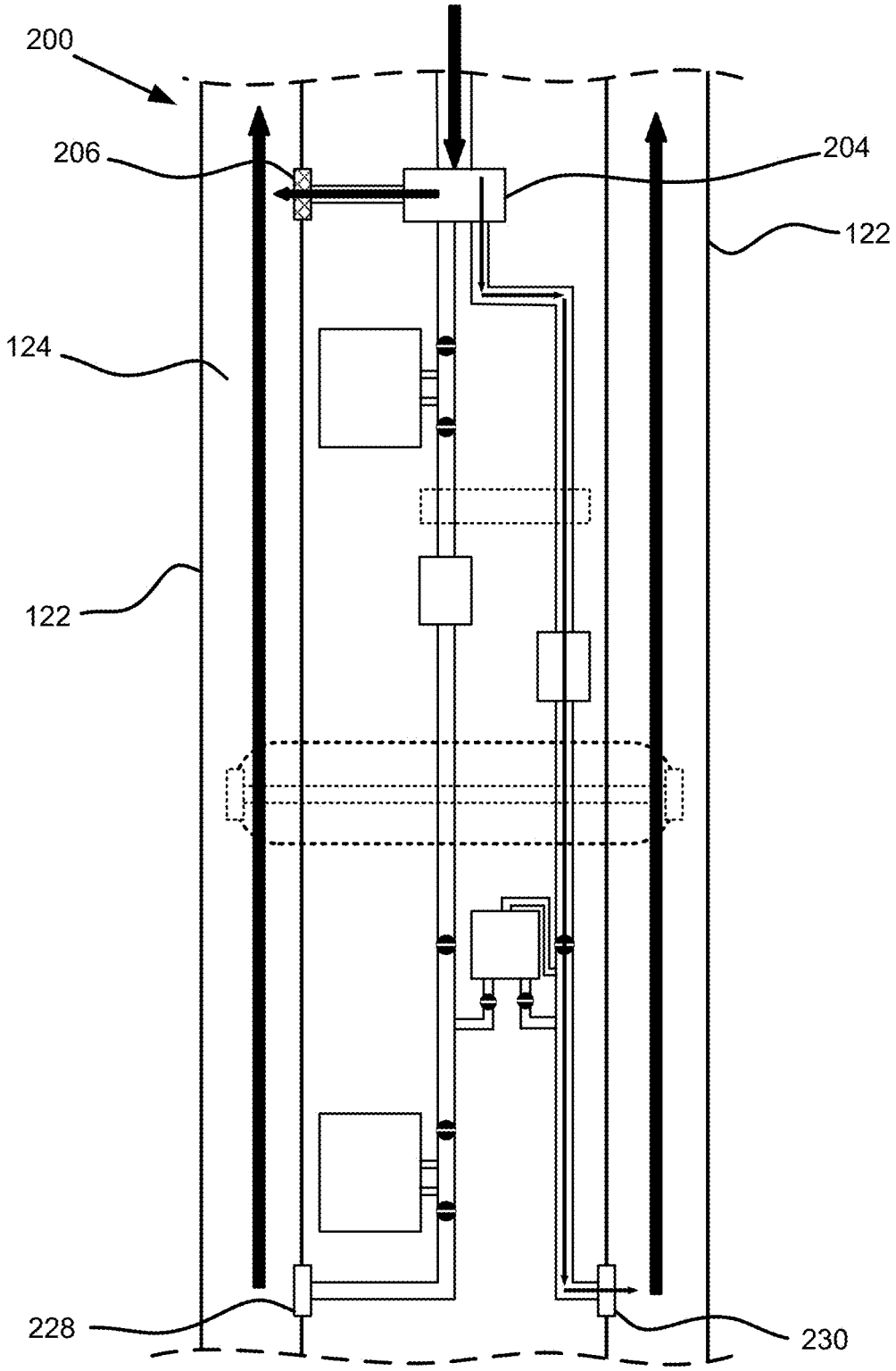

To manage the temperatures of components of bottom hole assembly 106, tool 100 may perform operations to (i) cool portions of well 120 and/or geological formation 110, (ii) cool the components of bottom hole assembly 106, and (iii) manage positioning of bottom hole assembly 106 to establish and position bottom hole assembly 106 in cooled zones in well 120. A cooled zone may be a region of the well that has been artificially cooled to a temperature below that which may be otherwise expected without the artificial cooling. Refer to FIGS. 2A-2C for additional details regarding bottom hole assembly 106.

Turning to FIG. 2A, a first diagram of bottom hole assembly 106 in accordance with an embodiment is shown. FIG. 2A and similar figures (e.g., 2B-2C) may show cross sections (e.g., down a center and/or along a length) of bottom hole assembly 106, and/or portions thereof. In the diagrams, wavy dashed lines are used to indicate that the structures shown may continue beyond that which is illustrated in each of the figures.

As noted above, bottom hole assembly 106 may facilitate performance of various downhole operations (e.g., sampling/characterizing, production, injection, etc.). Refer to FIGS. 3A-3D for additional details regarding performance of downhole operations.

Bottom hole assembly 106 may include various tool assemblies 200. A tool assembly may be a modularized component that may be added to other modularized components to form an assembly. Different tool assemblies 200 may perform similar or different functions. For example, tool assemblies 200 may include packers usable to isolate intervals of wells, production/sampling assemblies usable to extract/sample fluids produced from isolated intervals, downhole pump assemblies to pump various fluids, fluid analysis assemblies to analyze fluids as they are obtained, etc. Refer to FIGS. 2B-2C for additional information regarding the functions and components of tool assemblies 200.

Bottom hole assembly 106 may be connected to topside facilities (e.g., surface facilities) via drill pipe 292 (e.g., part of drill string 104). Through this connection, materials and control signals may be sent from surface facility to bottom hole assembly 106.

These materials and control signals may be used to operation bottom hole assembly 106. For example, when position in the well the materials circulated from the topside facilitate to bottom hole assembly 106 may be used to locally cool bottom hole assembly 106 and/or portions of the well. As will be discussed in greater detail below, the materials circulated to bottom hole assembly 106 via drill pipe 292 may be ejected into annulus 124 between wellbore wall/casing 122 and bottom hole assembly 106 for recirculation to the surface. The material may be cooled thereby enabling both the bottom hole assembly and portions of the well to be cooled (e.g., thereby established cooled zones).

While illustrated using specific components, it will be appreciated that bottom hole assembly 106 may include additional, different, and/or fewer components than those shown in FIG. 2A without departing from embodiments disclosed herein.

Turning to FIG. 2B, a first diagram showing example components of tool assemblies 200 in accordance with an embodiment is shown. To provide its functionality, tool assemblies 200 may include various lines (e.g., 202), switched manifold 204, circulation port 206, flowlines (e.g., 208, 210), various valves (e.g., 214), insert 216, pumps (e.g., 218, 220), packer module 222, mixing module 224, sample carrying modules (e.g., 212, 226), and ports (e.g., 228, 230). Each of these components is discussed below.

Line 202 may be a line used to place other components of tool assemblies 200 in fluid communication with drill string 104 (e.g., and in turn various topside facilities). Line 202 may, for example, directly connect drill string 104 to switched manifold 204. Consequently, materials from topside facilities may be pumped into/out of switched manifold 204 via line 202 and drill string 104.

Switched manifold 204 may be a manifold that places flowlines 208-210 in fluid communication with line 202. Switched manifold 204 may also selectively and reversibly place circulation port 206 in fluid communication with lines 202, 208, and 210. For example, switched manifold 204 may be actuated to modify the fluid flow through it to reversibly isolate circulation port 206 from line 202 and flowlines 208-210. Switched manifold 204 may include a valve or other flow control component usable to enable or terminate flows of material between circulation port 206 and other components connected to switched manifold 204.

Circulation port 206 may be a port that is in fluid communication with the ambient environment surrounding tool assemblies 200. Circulation port 206 may also be in fluid communication with switched manifold 204 (which may selectively connect circulation port 206 to or isolate circulation port 206 from line 202, flowline 208, and/or flowline 210).

Flowlines 208, 210 may place switched manifold 204 in fluid communication with ports 228, 230, respectively. Various components may be positioned along flowlines 208, 210 to facilitate, for example, pumping of materials along the flowlines using pumps 218, 220, respectively, sampling of materials in the flowlines using sample carrying modules 212, 226, mixing/flowing of materials between the flowlines using mixing module 224, etc. Additionally, flowlines 208, 210 may be in selective fluid communication with ports of packer module 222 that may allow samples of material obtained from proximate portions of geological formations to be obtained.

To control the flows of materials along flowlines 208, 210 various valves (e.g., 214) maybe positioned with the flowlines and components in fluid communication with the flowlines. In FIG. 2B, example locations of valves are shown using symbols. However, it will be appreciated that any number of valves may be included in tool assemblies 200 for flow control purposes. The valves, like pumps 218, 220, mixing module 224, switched manifold 204, sample carrying modules 212, 226, and packer module 222 may be computer controlled to facilitate orchestration of operation of tool assemblies 200.

Sample carrying modules 212, 226 may take and store samples of material from the flowlines (e.g., 210). The sampled material may be analyzed for various purposes (e.g., formation characterization).

Pumps 218, 220 may be material pumps positioned along flowlines 208, 210. Pumps 218, 220 may be any type of pump.

An insert (e.g., 216) may be used to reconfigure flows of material along flowlines 208, 210. For example, insert 216 may reroute materials between the flowlines. In the example shown in FIG. 2B, insert 216 is shown as not rerouting the flows of materials along flowlines 208, 210. However, it will be appreciated that insert 216 may (i) reroute material flows between flowlines, (ii) terminate material flows (e.g., seal a flowline), and/or otherwise modify material flows in flowlines 208, 210.

Packer module 222 may facilitate isolation of portions of a well. For example, packer module 222 may be expandable or otherwise modifiable in shape. The shape may be modified to annulus space to isolate segments of a well. Additionally, packer module 222 may include ports and various flow control components (not shown, may include valves, manifolds, etc.) to enable materials to be flowed into flowlines 208, 210 from the geological formation, isolated segment of the well, etc.

Ports 228, 230, like circulation port 206, may be in fluid communication with the annulus. Ports 228, 230 may be used to establish, for example, fluid flows through tool assemblies 200 usable to cool electronic components (and/or other types of components). Refer to FIG. 2C for additional information regarding such material flows.

While not shown, various electronic components may be positioned throughout tool assemblies 200. These electronic components (e.g., circuit cards, chips, discrete components, storage/memory/communication devices, motor drivers/controllers, actuator driver/controllers, sensor controllers, etc.) may have corresponding thermal operating ranges. As will be discussed in greater detail below, various cooling flows may be established and used to retain these and/or other types of components within the thermal operating ranges while tool assemblies 200 is downhole/exposed to elevated temperatures.

Turning to FIG. 2C, a first diagram illustrating a first example material flow pattern in accordance with an embodiment is shown. In FIG. 2C, the material flow pattern is illustrated using oversized arrows. The illustrated material flow may be a cooling flow usable to cool electronic components positioned in tool assemblies 200.

As seen in FIG. 2C, the material flow may flow from a topside facilitate (e.g., via pumping), through a drill string, and into tool assemblies 200. Switched manifold 204 may place circulation port 206 in fluid communication with the cooling flow. Consequently, when the material flow reaches switched manifold 204, at least two sub-flows may be established. One sub-flow may flow out of circulation port 206. The other sub-flow may continue through the interior of tool assemblies 200 via a flowline (in the figure, shown as the flowline on the right half of the page). The other sub-flow may then exit via one of the ports (e.g., 230 in the example shown in FIG. 2C).

The sub-flows may exit into the annulus and flow back to the topside facility. Accordingly, a cooling loop may be formed that is usable to cool both the interior of tool assemblies 200 and portions of the well.

Figure 3A:
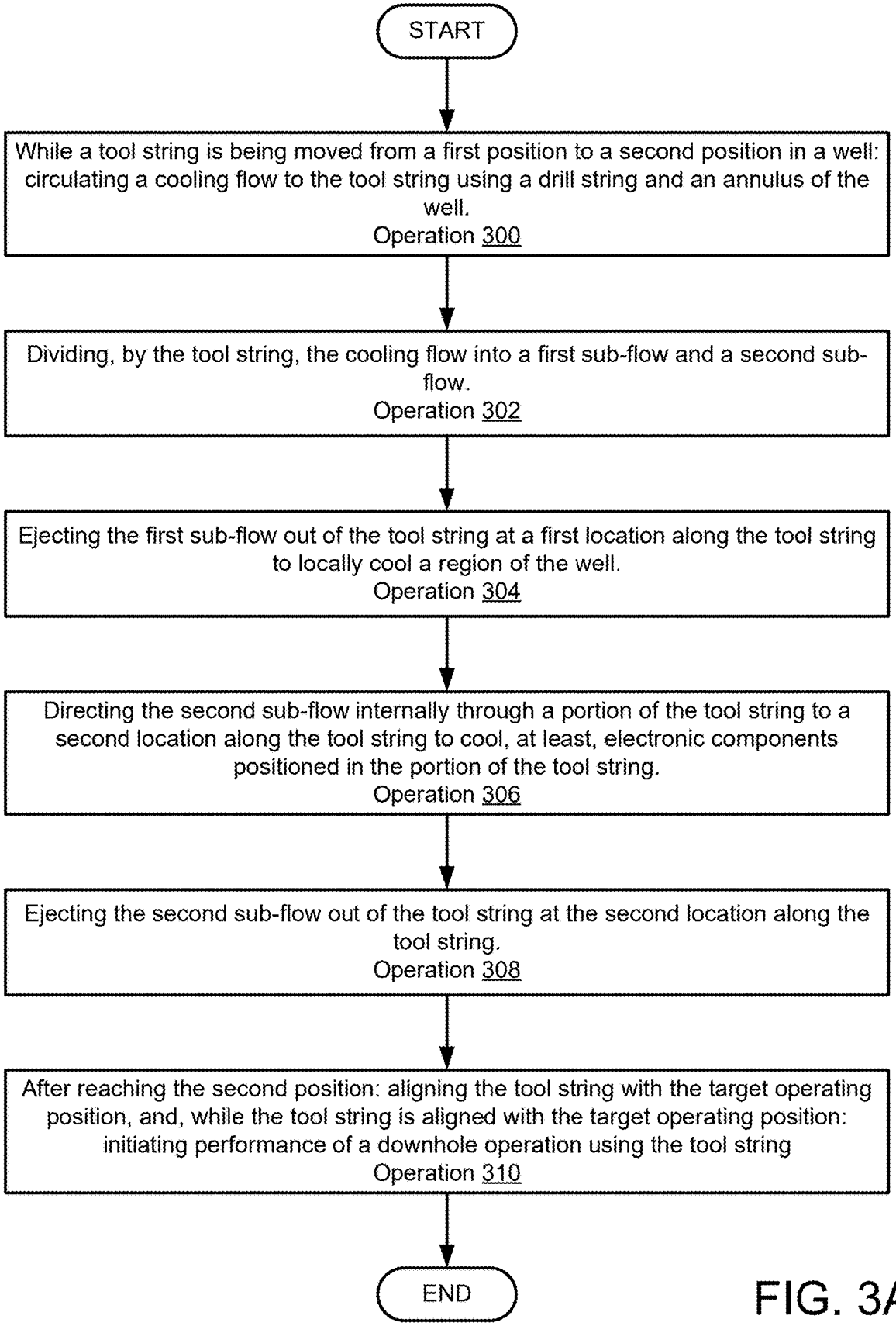
FIGS. 3A-3B show flow diagrams illustrating a method in accordance with an embodiment.
Figure 3B:
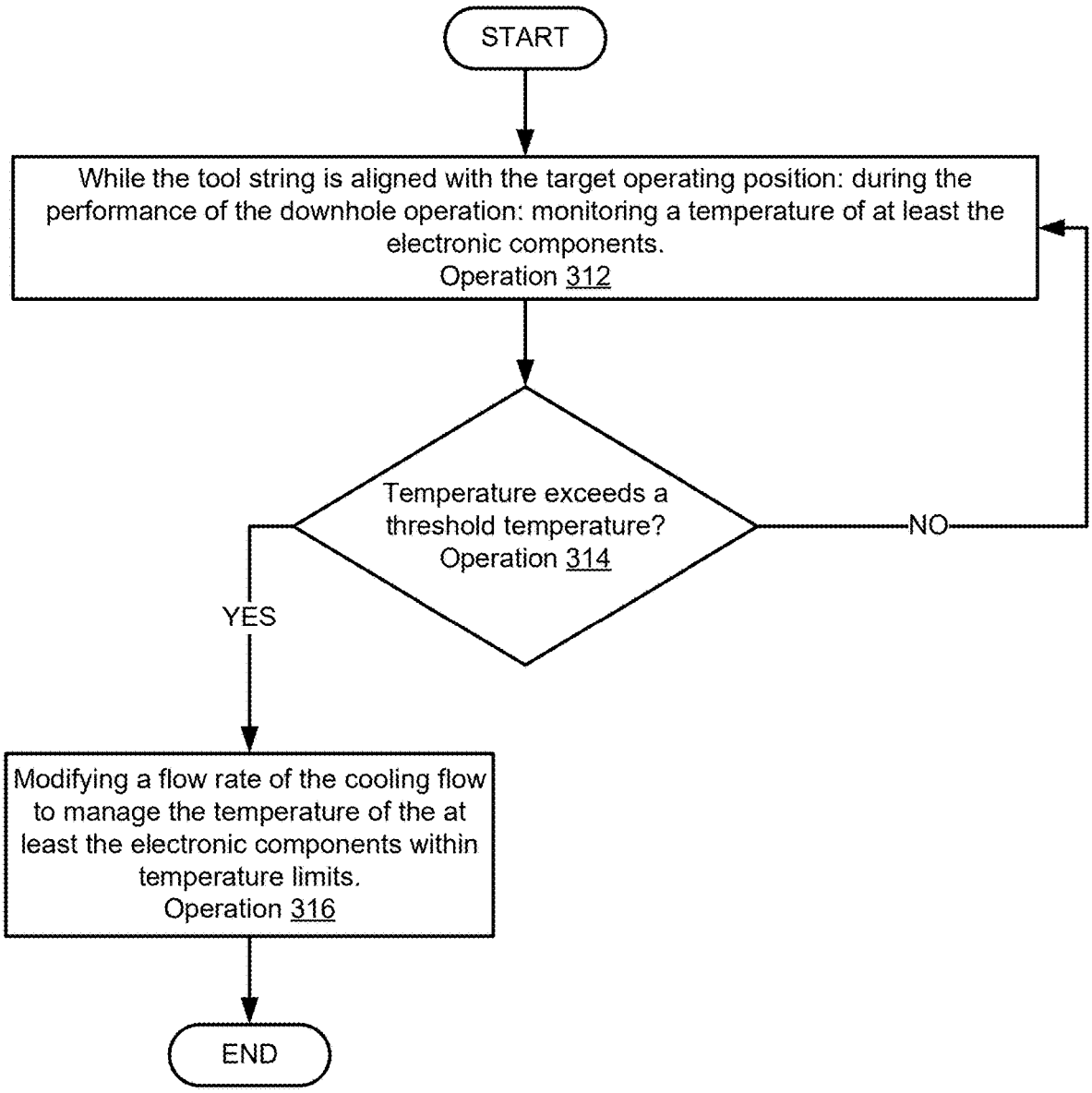

As discussed above, the components of FIGS. 1-2C may be used to perform various methods to facilitate operation, completion, and/or management of wells. FIGS. 3A-3B illustrate methods that may be performed by the components of the system of FIG. 1. In the diagrams discussed below and shown in FIGS. 3A-3B, any of the operations may be repeated, performed in different orders, and/or performed in parallel with or in a partially overlapping in time manner with other operations.

Turning to FIG. 3A, a first flow diagram illustrating a method for performing downhole operations in accordance with an embodiment is shown. The method may be performed, for example, by any of the components of the system shown in FIGS. 1-2C and 4.

At operation 300, while a tool string is being moved from a first position to a second position in a well, a cooling flow may be circulated to the tool string using a drill string and an annulus of the well. The tool string may include a bottom hole assembly and tool assemblies, as discussed with respect to FIGS. 1-2C.

To circulate the cooling flow, a top side facility may active one or more pumps. The pumps may be connected to material reservoirs, chillers, and/or other sources of material usable to establish cooling flows. The pumps may be connected to the drill string, thereby enabling the cooling flow to proceed through the drill string, to the tool string (e.g., including the bottom hole assembly), and then to return back to the surface via the annulus. Once at the surface, the cooling flow may be directed through various conditioners (e.g., separators to remove some materials that may have been entrained, chillers or other temperature management components to set a temperature of the cooling flow, etc.). Once conditioned, the material used to establish the cooling flow may be recirculated to continue the cooling flow.

Figure 3C:
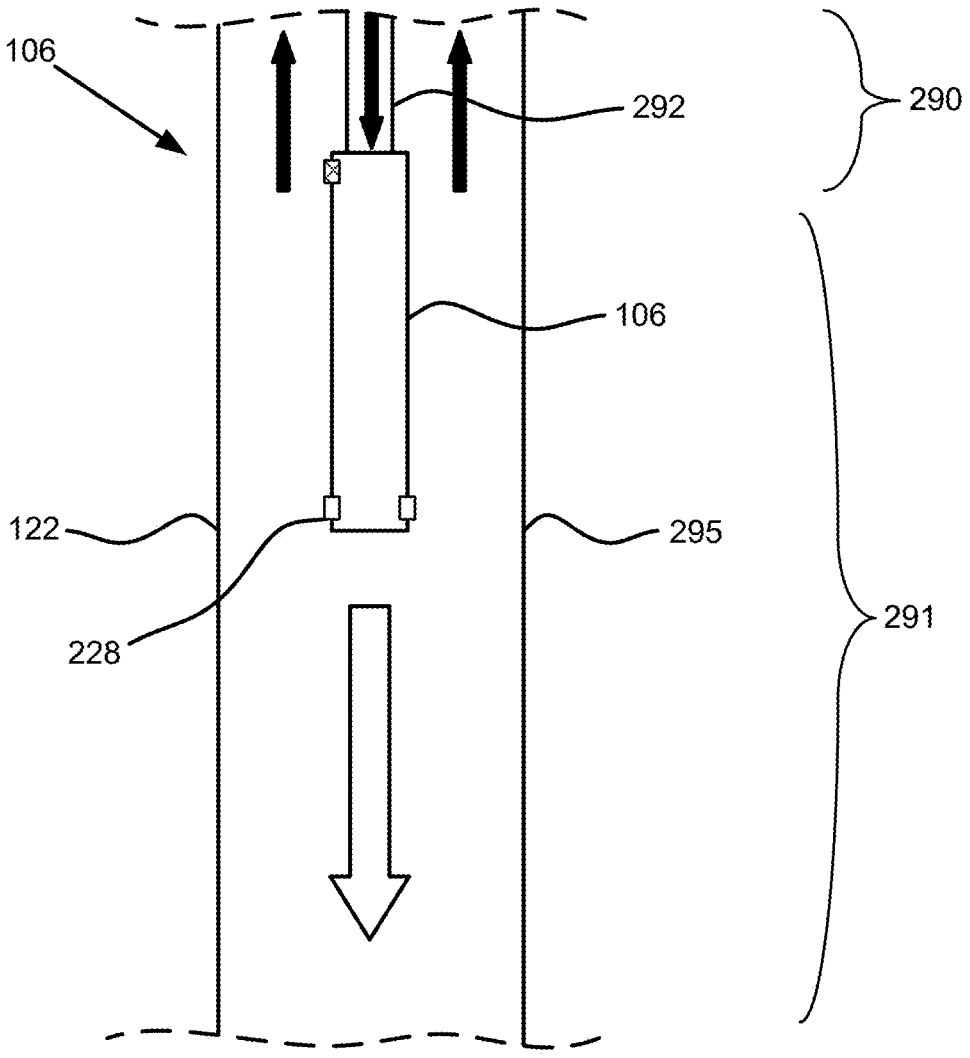
FIGS. 3C-3E show diagrams illustrating activity that may occur in a well in accordance with an embodiment.

For example, turning to FIG. 3C, a diagram illustrating an example of circulation of a cooling flow in accordance with an embodiment is shown. In FIG. 3C (and FIGS. 3D-3E), a side view diagram of a portion of a well is shown, with bottom hole assembly 106 (e.g., part of a tool string) positioned in the well. In FIG. 3C (and FIGS. 3D-3E), the relative dimensions of bottom hole assembly 106 and the well in which bottom hole assembly 106 is positioned have been adjusted from that which is likely to be found in field merely to improve readability of the diagrams. It will be appreciated that the dimensions may be different from those illustrated herein.

To perform downhole operations, bottom hole assembly 106 may need to be positioned based on an operating point 295 for the downhole operations. Operating point 295 may be selected based on the type of the downhole operation (e.g., sampling, production, injection, etc.), characteristics of the well and/or geological formation, and/or other factors.

However, operating point 295, in this example, is positioned in an excessive temperature zone 291. Excessive temperature zone 291 may be a section of the well where the ambient temperature exceeds prescribed limits (e.g., temperatures that may cause various components of bottom hole assembly 106 to exceed thermal operating ranges). The excessive temperatures may be due, for example, to a geological formation in which the well is positioned.

To operate with respect to operating point 295, bottom hole assembly 106 may be lowered (illustrated using an oversized arrow) in the well toward operating point 295.

Returning to the discussion of FIG. 3A, at operation 302, the cooling flow may be divided into a first sub-flow and a second sub-flow. The cooling flow may be divided by feeding the cooling flow into a manifold. The manifold may be in fluid communication with a flowline (e.g., which may eventually lead to a port lower on the bottom hole assembly) and a circulation port. While the circulation port is open, at least two flow paths from the manifold may be present thereby causing the cooling flow to divide into the two sub-flows (e.g., due to pressure differentials). Consequently, the first sub-flow may flow out of the circulation port and into the annulus, while the second sub-flow may flow through the flowline as discussed in greater detail below.

At operation 304, the first sub-flow may be ejected out of the tool string at a first location along the tool string to locally cool a region of the well. The first location may be the circulation port. The first sub-flow may be ejected by virtue of the pumping activity of the surface facility.

At operation 306, the second sub-flow may be directed internally through a portion of the tool string to a second location along the tool string to cool, at least, electronic components positioned in the portion of the tool string. The second sub-flow may be directed by the manifold, and by virtue of pressure differentials between the flow into the manifold and downstream outlets. For example, a flowline to a port that also exists to the annulus may be connected to the manifold and receive the second sub-flow. The lower pressure in the annulus and higher pressure in the manifold may cause the second sub-flow to flow through the flowline. The flowline may be positioned with the portion of the tool string.

The flowline may be in thermal communication with various electronic components. Consequently, heat from these components may be dissipated in the second sub-flow. The flowline may run down to the second location (e.g., a port to the annulus) along the tool string.

At operation 308, the second sub-flow may be ejected out of the tool string at the second location along the tool string. The second sub-flow may be ejected out of a port at the second location and into the annulus. The surface pumping may draw material up along the annulus to the stop side facility.

Thus, operations 306-308 may both cool portions of the well (and/or surrounding geological formation) and components positioned in the tool string as the tool string is moved.

At operation 310, after reaching the second position, the tool string may be aligned with a target operating position along the well. The target operating position may be above the second position.

When the tool string is at the second position, the tool string may be further down in the well than the target operating position. By traveling to the second position, the target operating position may be locally cooled.

Figure 3D:
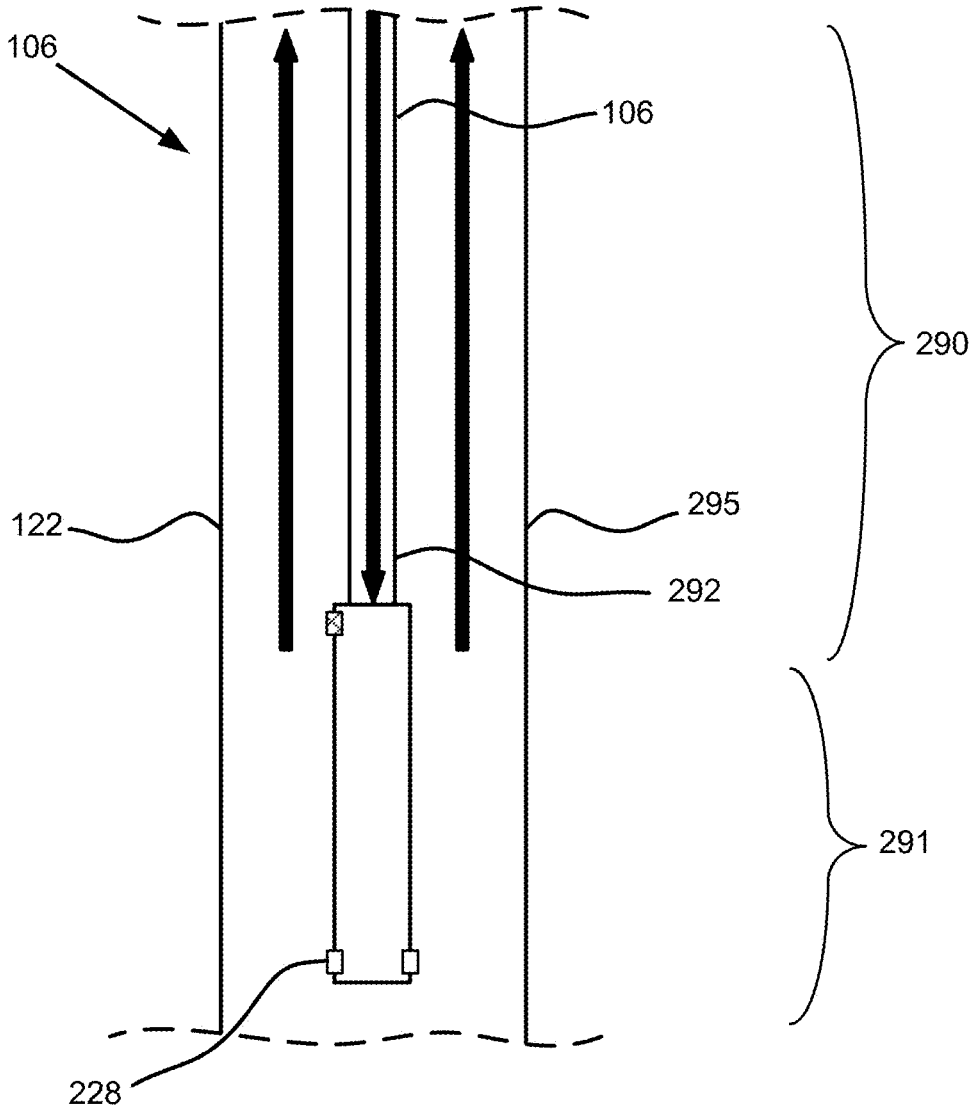

For example, turning to FIG. 3D, a diagram illustrating an example movement of a bottom hole assembly in accordance with an embodiment is shown.

To perform downhole operations, bottom hole assembly 106 may be moved deeper into the well so that bottom hole assembly 106 is lower in the well than is necessary to perform downhole operations at operating point 295. By moving in this manner, the cooling flow (e.g., illustrated using oversized arrows) may pass by operating point 295 thereby extending cooled zone 290 to encompass operating point 295. Consequently, operation point 300 may no longer be located in excessive temperature zone 291.

Returning to the discussion of FIG. 3A, to align the tool string with the target operating position (e.g., operating point 295 in this example), an offset may be calculated using any method. The offset may be calculated to align one or more tools of the tool string with the operating position. Once calculated, the tool string may be raised by the offset to align the tool string with the target operating position.

The tool may be, for example, a sampling tool to obtain formation/material samples, an injection tool to inject materials into a formation, a production tool to produce materials (e.g., hydrocarbon laden gasses/liquids), and/or other types of downhole tools.

Figure 3E:
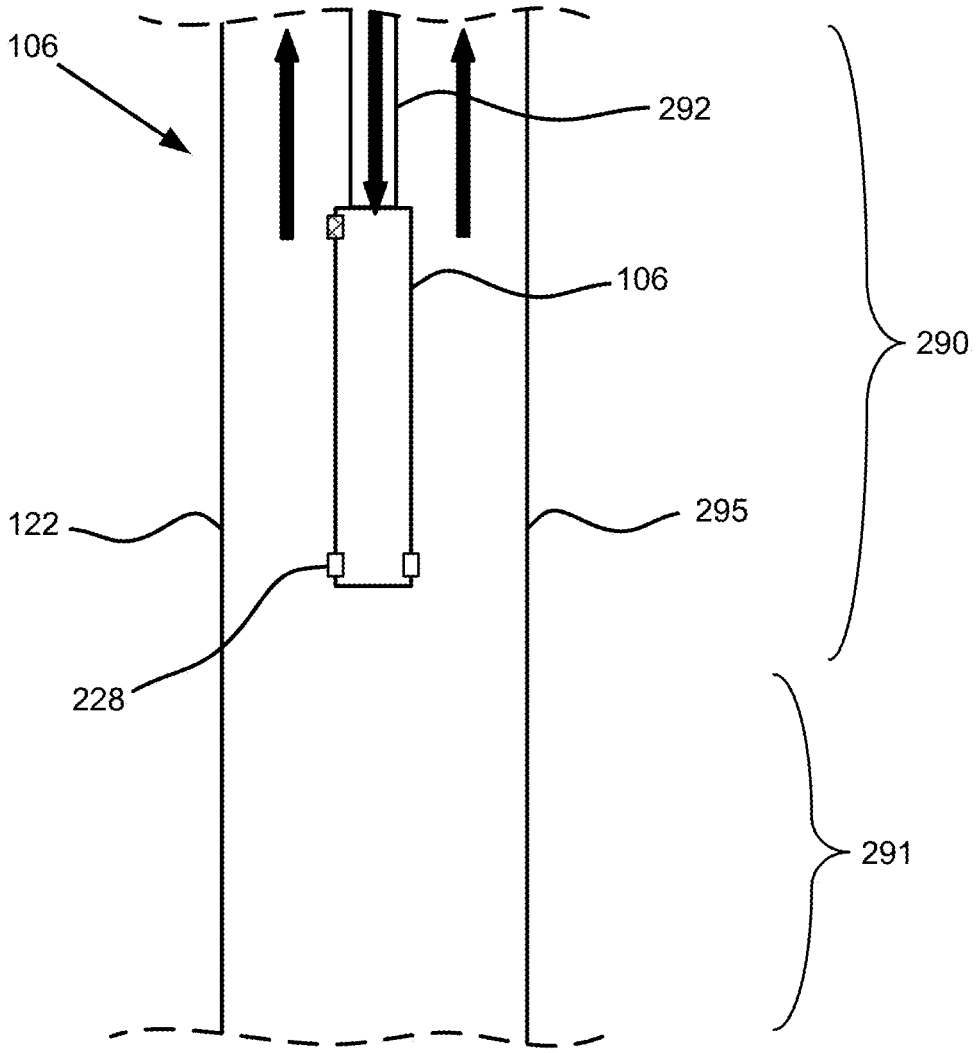

For example, turning to FIG. 3E, a diagram illustrating another example movement of a bottom hole assembly in accordance with an embodiment is shown.

To align the tool string with operating point 295, bottom hole assembly 106 may be moved upward (e.g., by the offset) in the well so that a tool positioned with bottom hole assembly 106 is aligned with operating point 295. By moving in this manner, bottom hole assembly 106 may be both positioned in cooled zone 290 and aligned with operating point 295.

Returning to the discussion of FIG. 3A, by pre-cooling a zone of a well and operating the tool string within that zone, the temperatures of components of the tool string may be less likely to exceed operating limits.

Turning to FIG. 3B, a second flow diagram illustrating a continuation of the flow diagram shown in FIG. 3A is shown.

At operation 312, while the tool string is aligned with the target operating position and during performance of a downhole operation, a temperature of at least electronic components of the tool string is monitored. Performance of the downhole operation may require that the cooling flow be reduced in magnitude, stopped entirely, rerouted inside the tool string, and/or otherwise modified. These modifications to the cooling flow may cause the cooling flow to be unable to retain electronic components within the tool string from overheating. The temperature of the at least one electronic component may be measured using temperatures sensors (e.g., thermistors). The temperature measurements may be stored for use in the future (e.g., to establish trends).

At operation 314, a determination is made regarding whether the temperature of any of the electronic components exceeds a threshold temperature. The threshold temperature may be based on the operating limits of the measured electronic component. For example, the threshold temperature may be an upper operating temperature limit, or may be reduced from that amount by a factor of safety (e.g., if the operating limiting is 200° F., the factor of safety may be 5% or 10° giving a limit of) 195°.

If the temperature exceeds the threshold temperature, then the method may proceed to operation 316. Otherwise, the method may proceed to operation 312.

At operation 316, a flow rate of the cooling flow is modified to manage the temperature of the at least the electronic components within temperature limits. The flow rate may be modified, for example, by activating pumps of the tool string and/or surface pumps.

The pumps of the tool string may pump material from the manifold and out of a port. Consequently, a flow of cooling material may be established that may cool electronic components positioned within the tool string. The flow rate may be set, for example, based on the temperature of the electronic components and/or expected future temperatures (e.g., based on trends).

The method may end following operation 316.

Thus, using the method illustrated in FIGS. 3A-3B, embodiments disclosed herein may reduce the likelihood of damaging or impairing the operation of components of tool strings due to exposure to excessive temperatures (e.g., outside operating limits).

Figure 4:
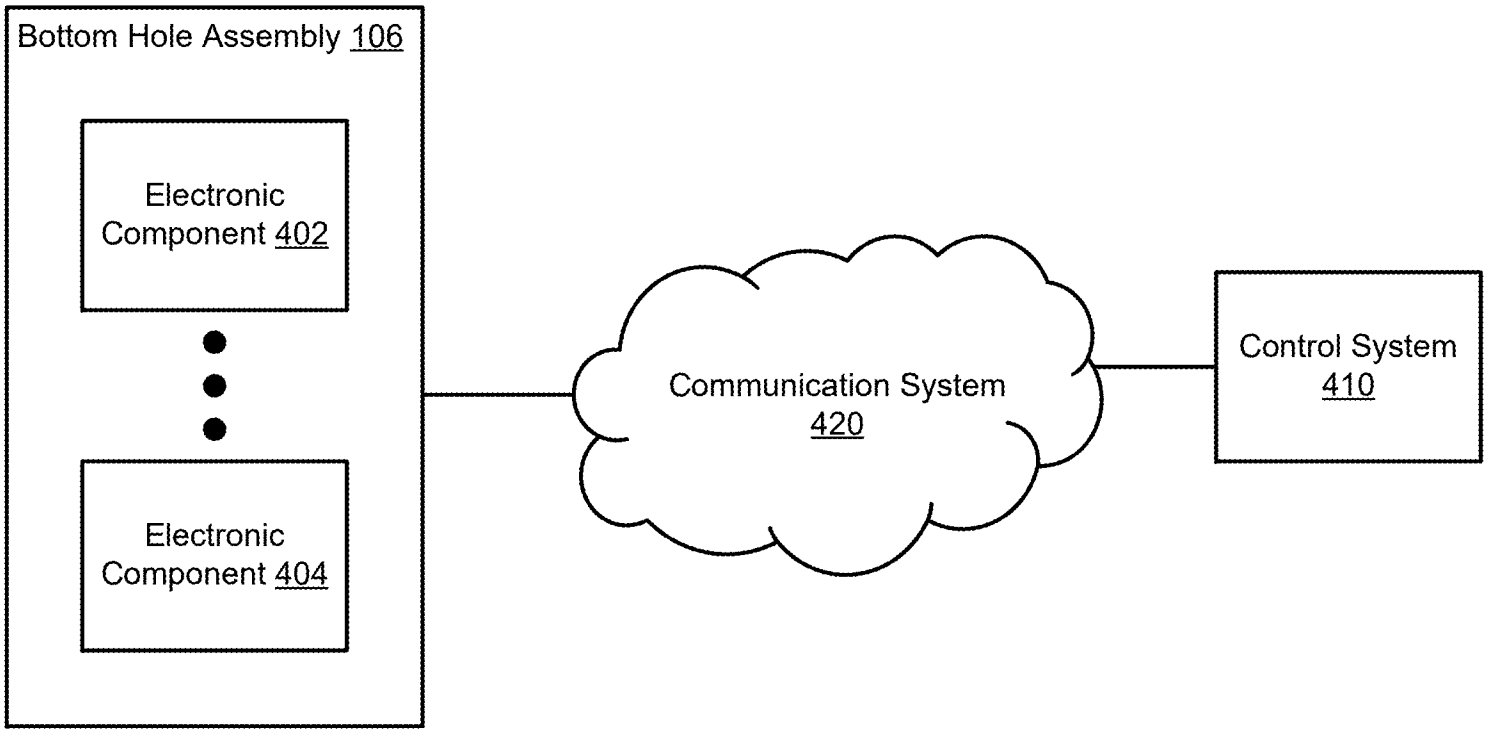
FIG. 4 shows a block diagram of a system in accordance with an embodiment.

Turning to FIG. 4, a block diagram of a system in accordance with an embodiment is shown. The system may be used to manage the operation of tool strings (e.g., including bottom hole assemblies) in wells.

To provide the above noted functionality, the system of FIG. 4 may include bottom hole assembly 106, control system 410, and communication system 420. Each of these components is discussed below.

As discussed above, bottom hole assembly may perform various downhole operations. To do so, bottom hole assembly 106 may include various electronic components (e.g., 402, 404). The electronic components may include various hardware components such as processors, memory, storage device, etc. that may operate, in part, as a computer. The computer may control various processes and other components of bottom hole assembly 106.

Control system 410 may manage the operation of bottom hole assembly 106 and/or other components positioned with a well. For example, control system 410 may orchestrate the operation of any number of computer controlled components such as bottom hole assembly 106 to perform various processes.

Control system 410 may include one or more computing units (e.g., central processing units, microcontrollers, etc.) of tool 100 used to manage the operation of bottom hole assembly 106. For example, the computing units may store code usable to manage operation of the assemblies of bottom hole assembly 106 to perform downhole operations. During the downhole operations, the computing units may read various sensors (e.g., flow, pressure, etc.) positioned to capture information usable to derive information regarding and/or grade intervals for various purposes thereby obtaining various test results.

When providing their functionality, any of (and/or components thereof) planning system 400 and control system 410 may perform all, or a portion, of the actions and methods illustrated in FIGS. 2A-3E.

Any of (and/or components thereof) bottom hole assembly 106 and control system 410 may be implemented using a computing device (also referred to as a data processing system) such as a host or a server, a personal computer (e.g., desktops, laptops, and tablets), a "thin" client, a personal digital assistant (PDA), a Web enabled appliance, a mobile phone (e.g., Smartphone), an embedded system, local controllers, an edge node, and/or any other type of data processing device or system. For additional details regarding computing devices, refer to FIG. 5.

Any of the components illustrated in FIG. 4 may be operably connected to each other (and/or components not illustrated) with communication system 420. In an embodiment, communication system 420 includes one or more networks that facilitate communication between any number of components. The networks may include wired networks and/or wireless networks (e.g., and/or the Internet). The networks may operate in accordance with any number and types of communication protocols (e.g., such as the internet protocol). Communication system 420 may also include various wirelines used to carry control signals between topside facilities and tools in a well.

While illustrated in FIG. 4 as including a limited number of specific components, a system in accordance with an embodiment may include fewer, additional, and/or different components than those illustrated therein.

Thus, using the methods described with respect to FIG. 3A-3E and system illustrated in FIGS. 1-2C and 4, embodiments disclosed herein may improve the likelihood of successfully exploiting geological formation for various purposes. The likelihood of success may be improved by reducing the likelihood of electronic components becoming damaged, impaired, or otherwise operating in undesired manners.

Thus, embodiments disclosed herein may address the technical challenge of performing downhole operations in challenging environments. The disclosed embodiments may do so by managing the temperatures of downhole components using cooling flows.

Figure 5:
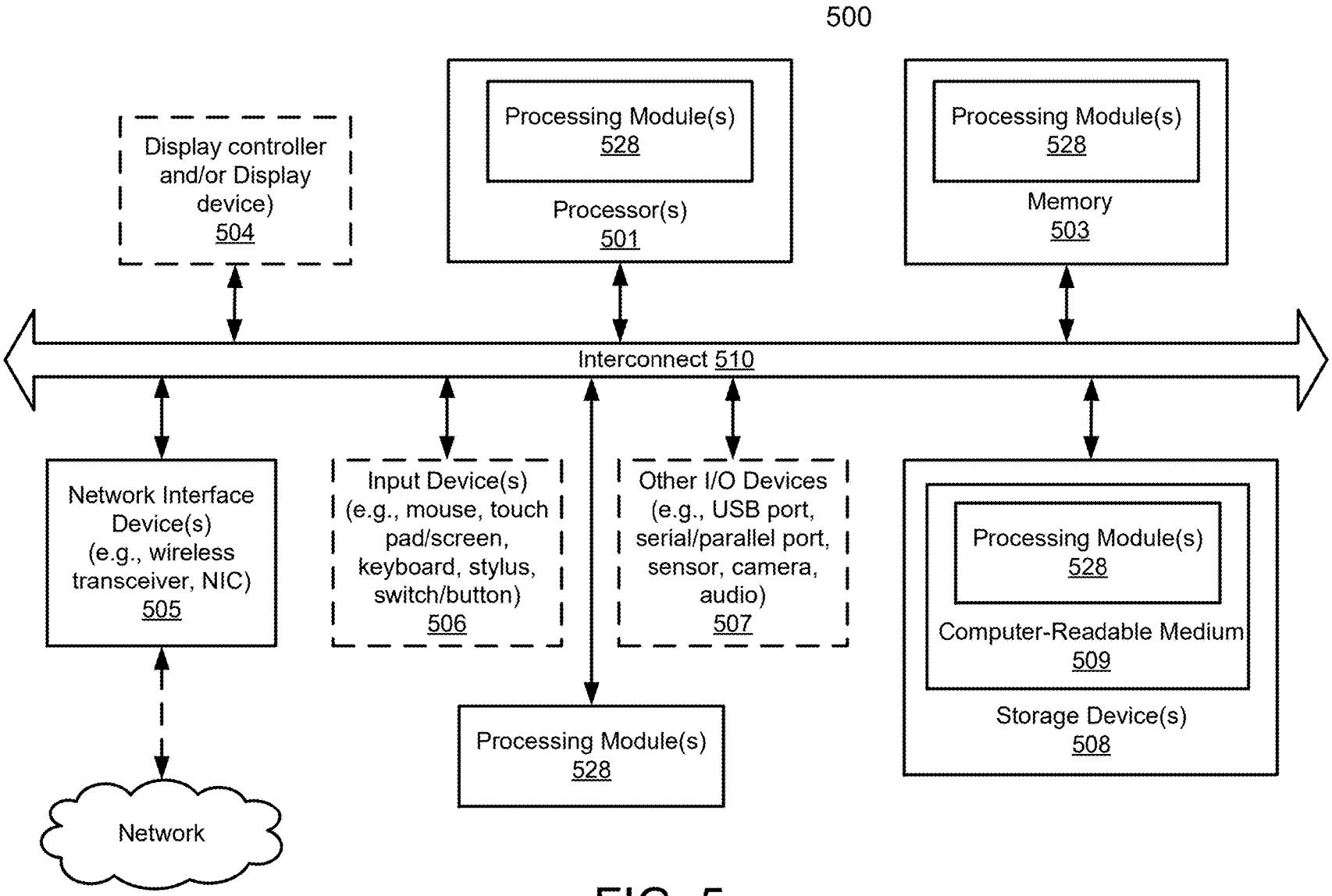
FIG. 5 shows a block diagram illustrating a data processing system in accordance with an embodiment.

Any of the components illustrated in FIGS. 1-4 may be implemented with one or more computing devices. Turning to FIG. 5, a block diagram illustrating an example of a data processing system (e.g., a computing device) in accordance with an embodiment is shown. For example, system 500 may represent any of data processing systems described above performing any of the processes or methods described above. System 500 can include many different components. These components can be implemented as integrated circuits (ICs), portions thereof, discrete electronic devices, or other modules adapted to a circuit board such as a motherboard or add-in card of the computer system, or as components otherwise incorporated within a chassis of the computer system. Note also that system 500 is intended to show a high level view of many components of the computer system. However, it is to be understood that additional components may be present in certain implementations and furthermore, different arrangement of the components shown may occur in other implementations. System 500 may represent a desktop, a laptop, a tablet, a server, a mobile phone, a media player, a personal digital assistant (PDA), a personal communicator, a gaming device, a network router or hub, a wireless access point (AP) or repeater, a set-top box, or a combination thereof. Further, while only a single machine or system is illustrated, the term "machine" or "system" shall also be taken to include any collection of machines or systems that individually or jointly execute a set (or multiple sets) of instructions to perform any one or more of the methodologies discussed herein.

In an embodiment, system 500 includes processor 501, memory 503, and devices 505-507 via a bus or an interconnect 510. Processor 501 may represent a single processor or multiple processors with a single processor core or multiple processor cores included therein. Processor 501 may represent one or more general-purpose processors such as a microprocessor, a central processing unit (CPU), or the like. More particularly, processor 501 may be a complex instruction set computing (CISC) microprocessor, reduced instruction set computing (RISC) microprocessor, very long instruction word (VLIW) microprocessor, or processor implementing other instruction sets, or processors implementing a combination of instruction sets. Processor 501 may also be one or more special-purpose processors such as an application specific integrated circuit (ASIC), a cellular or baseband processor, a field programmable gate array (FPGA), a digital signal processor (DSP), a network processor, a graphics processor, a network processor, a communications processor, a cryptographic processor, a co-processor, an embedded processor, or any other type of logic capable of processing instructions.

Processor 501, which may be a low power multi-core processor socket such as an ultra-low voltage processor, may act as a main processing unit and central hub for communication with the various components of the system. Such processor can be implemented as a system on chip (SoC). Processor 501 is configured to execute instructions for performing the operations discussed herein. System 500 may further include a graphics interface that communicates with optional graphics subsystem 504, which may include a display controller, a graphics processor, and/or a display device.

Processor 501 may communicate with memory 503, which in an embodiment can be implemented via multiple memory devices to provide for a given amount of system memory. Memory 503 may include one or more volatile storage (or memory) devices such as random access memory (RAM), dynamic RAM (DRAM), synchronous DRAM (SDRAM), static RAM (SRAM), or other types of storage devices. Memory 503 may store information including sequences of instructions that are executed by processor 501, or any other device. For example, executable code and/or data of a variety of operating systems, device drivers, firmware (e.g., input output basic system or BIOS), and/or applications can be loaded in memory 503 and executed by processor 501. An operating system can be any kind of operating systems, such as, for example, Windows® operating system from Microsoft®, Mac OS®/iOS® from Apple, Android® from Google®, Linux®, Unix®, or other real-time or embedded operating systems such as VxWorks.

System 500 may further include IO devices such as devices (e.g., 505, 506, 507, 508) including network interface device(s) 505, optional input device(s) 506, and other optional IO device(s) 507. Network interface device(s) 505 may include a wireless transceiver and/or a network interface card (NIC). The wireless transceiver may be a WiFi transceiver, an infrared transceiver, a Bluetooth transceiver, a WiMax transceiver, a wireless cellular telephony transceiver, a satellite transceiver (e.g., a global positioning system (GPS) transceiver), or other radio frequency (RF) transceivers, or a combination thereof. The NIC may be an Ethernet card.

Input device(s) 506 may include a mouse, a touch pad, a touch sensitive screen (which may be integrated with a display device of optional graphics subsystem 504), a pointer device such as a stylus, and/or a keyboard (e.g., physical keyboard or a virtual keyboard displayed as part of a touch sensitive screen). For example, input device(s) 506 may include a touch screen controller coupled to a touch screen. The touch screen and touch screen controller can, for example, detect contact and movement or break thereof using any of a plurality of touch sensitivity technologies, including but not limited to capacitive, resistive, infrared, and surface acoustic wave technologies, as well as other proximity sensor arrays or other elements for determining one or more points of contact with the touch screen.

IO devices 507 may include an audio device. An audio device may include a speaker and/or a microphone to facilitate voice-enabled functions, such as voice recognition, voice replication, digital recording, and/or telephony functions. Other IO devices 507 may further include universal serial bus (USB) port(s), parallel port(s), serial port(s), a printer, a network interface, a bus bridge (e.g., a PCI-PCI bridge), sensor(s) (e.g., a motion sensor such as an accelerometer, gyroscope, a magnetometer, a light sensor, compass, a proximity sensor, etc.), or a combination thereof. IO device(s) 507 may further include an imaging processing subsystem (e.g., a camera), which may include an optical sensor, such as a charged coupled device (CCD) or a complementary metal-oxide semiconductor (CMOS) optical sensor, utilized to facilitate camera functions, such as recording photographs and video clips. Certain sensors may be coupled to interconnect 510 via a sensor hub (not shown), while other devices such as a keyboard or thermal sensor may be controlled by an embedded controller (not shown), dependent upon the specific configuration or design of system 500.

To provide for persistent storage of information such as data, applications, one or more operating systems and so forth, a mass storage (not shown) may also couple to processor 501. In an embodiments, to enable a thinner and lighter system design as well as to improve system responsiveness, this mass storage may be implemented via a solid state device (SSD). In an embodiments, the mass storage may primarily be implemented using a hard disk drive (HDD) with a smaller amount of SSD storage to act as an SSD cache to enable non-volatile storage of context state and other such information during power down events so that a fast power up can occur on re-initiation of system activities. Also a flash device may be coupled to processor 501, e.g., via a serial peripheral interface (SPI). This flash device may provide for non-volatile storage of system software, including a basic input/output software (BIOS) as well as other firmware of the system.

Storage device 508 may include computer-readable storage medium 509 (also known as a machine-readable storage medium or a computer-readable medium) on which is stored one or more sets of instructions or software (e.g., processing module, unit, and/or processing module/unit/logic 528) embodying any one or more of the methodologies or functions described herein. Processing module/unit/logic 528 may represent any of the components described above. Processing module/unit/logic 528 may also reside, completely or at least partially, within memory 503 and/or within processor 501 during execution thereof by system 500, memory 503 and processor 501 also constituting machine-accessible storage media. Processing module/unit/logic 528 may further be transmitted or received over a network via network interface device(s) 505.

Computer-readable storage medium 509 may also be used to store some software functionalities described above persistently. While computer-readable storage medium 509 is shown in an embodiment to be a single medium, the term "computer-readable storage medium" should be taken to include a single medium or multiple media (e.g., a centralized or distributed database, and/or associated caches and servers) that store the one or more sets of instructions. The terms "computer-readable storage medium" shall also be taken to include any medium that is capable of storing or encoding a set of instructions for execution by the machine and that cause the machine to perform any one or more of the methodologies of embodiments disclosed herein. The term "computer-readable storage medium" shall accordingly be taken to include, but not be limited to, solid-state memories, and optical and magnetic media, or any other non-transitory machine-readable medium.

Processing module/unit/logic 528, components and other features described herein can be implemented as discrete hardware components or integrated in the functionality of hardware components such as ASICS, FPGAs, DSPs or similar devices. In addition, processing module/unit/logic 528 can be implemented as firmware or functional circuitry within hardware devices. Further, processing module/unit/logic 528 can be implemented in any combination hardware devices and software components.

Note that while system 500 is illustrated with various components of a data processing system, it is not intended to represent any particular architecture or manner of interconnecting the components; as such details are not germane to embodiments disclosed herein. It will also be appreciated that network computers, handheld computers, mobile phones, servers, and/or other data processing systems which have fewer components or perhaps more components may also be used with embodiments disclosed herein.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Embodiments disclosed herein also relate to an apparatus for performing the operations herein. Such a computer program is stored in a non-transitory computer readable medium. A non-transitory machine-readable medium includes any mechanism for storing information in a form readable by a machine (e.g., a computer). For example, a machine-readable (e.g., computer-readable) medium includes a machine (e.g., a computer) readable storage medium (e.g., read only memory ("ROM"), random access memory ("RAM"), magnetic disk storage media, optical storage media, flash memory devices).

The processes or methods depicted in the preceding figures may be performed by processing logic that comprises hardware (e.g. circuitry, dedicated logic, etc.), software (e.g., embodied on a non-transitory computer readable medium), or a combination of both. Although the processes or methods are described above in terms of some sequential operations, it should be appreciated that some of the operations described may be performed in a different order. Moreover, some operations may be performed in parallel rather than sequentially.

Embodiments disclosed herein are not described with reference to any particular programming language. It will be appreciated that a variety of programming languages may be used to implement the teachings of embodiments disclosed herein.

In the foregoing specification, embodiments have been described with reference to specific exemplary embodiments thereof. It will be evident that various modifications may be made thereto without departing from the broader spirit and scope of the embodiments disclosed herein as set forth in the following claims. The specification and drawings are, accordingly, to be regarded in an illustrative sense rather than a restrictive sense.

What is claimed is:

1. A method of operating a tool string, the method comprising:

while the tool string is being moved from a first position to a second position in a well:

circulating a cooling flow to the tool string using a supply line and an annulus of the well;

dividing, by a manifold within an interior of a body of the tool string, the cooling flow into a first sub-flow along a first flow line between the manifold and a first port, a second sub-flow along a second flow line between the manifold and a second port, and a third sub-flow along a third flow line between the manifold and a third port, wherein the first, second, and third flow lines are within the interior of the body, and the first, second, and third ports are in fluid communication with the annulus;

ejecting the first sub-flow out of the body of the tool string via the first port at a first location along the tool string to locally cool a region of the well;

directing the second sub-flow through the second flow line internally through a first portion of the tool string to the second port at a second location along the tool string to cool, at least, one or more electronic components within the interior of the body positioned in the first portion of the tool string; and ejecting the second sub-flow out of the body of the tool string via the second port at the second location along the tool string.

2. The method of claim 1, comprising directing the third sub-flow through the third flow line internally through a second portion of the tool string to the third port at a third location along the tool string to cool, at least, the one or more electronic components within the interior of the body positioned in the second portion of the tool string, wherein the second flow line extends a first axial distance from the manifold to the second port, wherein the third flow line extends a second axial distance from the manifold to the third port, and wherein the first and second axial distances axially overlap with one another in a downhole direction away from the manifold.

3. The method of claim 2, further comprising:

adjusting flow of the second sub-flow via one or more first valves and a first pump along the second flow line; and adjusting flow of the third sub-flow via one or more second valves and a second pump along the third flow line.

4. The method of claim 3, further comprising:

isolating a portion of the well via a packer coupled to the body of the tool string about the second and third flow lines, wherein the packer is disposed axially between the first port at the first location and the second and third ports at the respective second and third locations; and acquiring and storing one or more samples of material via one or more sample carrying modules coupled to at least the third flow line.

5. The method of claim 3, further comprising mixing flows between the second and third flow lines via a mixing module fluidly coupled to the second and third flow lines.

6. The method of claim 3, further comprising rerouting flows between the second and third flow lines via a flow control insert fluidly coupled to the second and third flow lines.

7. The method of claim 2, wherein the second and third locations of the respective second and third ports are the same axial locations.

8. The method of claim 1, further comprising:

after reaching the second position:

aligning the tool string with a target operating position, wherein aligning the tool string comprises raising the tool string from the second position and into the region of the well; and while the tool string is aligned with the target operating position:

initiating performance of a downhole operation using the tool string, wherein initiating the performance of the downhole operation reduces a flow rate of the cooling flow, wherein the downhole operation comprises at least one of:

interrogating a geological formation proximate to the region of the well to obtain information usable to identify properties of the geological formation and/or materials positioned with the geological formation;

extraction of at least a portion of the materials positioned with the geological formation; or injection of another material into the geological formation;

during the performance of the downhole operation:

monitoring a temperature of at least the electronic components; and in an instance of the monitoring of the temperature where the temperature exceeds a threshold temperature:

modifying a flow rate of the cooling flow to manage the temperature of the at least the electronic components within temperature limits, the threshold temperature being based on the temperature limits, wherein the temperature limits are based on hardware components of the electronic components, the hardware components being subject to damage and/or undesired operation when exposed to temperatures outside of the temperature limits.

9. The method of claim 1, wherein circulating the cooling flow comprises:

pumping a material from a top side facility, through the supply line to the tool string, out of the tool string, and back to the top side facility.

10. A system, comprising:

a processor; and a memory coupled to the processor to store instructions, which when executed by the processor, cause operations for operating a tool string to be performed, the operations comprising:

while the tool string is being moved from a first position to a second position in a well:

circulating a cooling flow to the tool string using a supply line and an annulus of the well;

dividing, by a manifold within an interior of a body of the tool string, the cooling flow into a first sub-flow along a first flow line between the manifold and a first port, a second sub-flow along a second flow line between the manifold and a second port, and a third sub-flow along a third flow line between the manifold and a third port, wherein the first, second, and third flow lines are within the interior of the body, and the first, second, and third ports are in fluid communication with the annulus;

ejecting the first sub-flow out of the body of the tool string via the first port at a first location along the tool string to locally cool a region of the well;

directing the second sub-flow through the second flow line internally through a first portion of the tool string to the second port at a second location along the tool string to cool, at least, one or more electronic components within the interior of the body positioned in the first portion of the tool string; and ejecting the second sub-flow out of the body of the tool string via the second port at the second location along the tool string.

11. The system of claim 10, wherein the operations further comprise directing the third sub-flow through the third flow line internally through a second portion of the tool string to the third port at a third location along the tool string to cool, at least, the one or more electronic components within the interior of the body positioned in the second portion of the tool string, wherein the second flow line extends a first axial distance from the manifold to the second port, wherein the third flow line extends a second axial distance from the manifold to the third port, and wherein the first and second axial distances axially overlap with one another in a downhole direction away from the manifold.

12. The system of claim 11, further comprising:

adjusting flow of the second sub-flow via one or more first valves and a first pump along the second flow line; and adjusting flow of the third sub-flow via one or more second valves and a second pump along the third flow line.

13. The system of claim 10, further comprising:

isolating a portion of the well via a packer coupled to the body of the tool string about the second and third flow lines, wherein the packer is disposed axially between the first port at the first location and the second and third ports at the respective second location and a third location.

14. The system of claim 10, further comprising acquiring and storing one or more samples of material via one or more sample carrying modules coupled to at least the third flow line.

15. The system of claim 10, further comprising:

mixing flows between the second and third flow lines via a mixing module fluidly coupled to the second and third flow lines; and rerouting flows between the second and third flow lines via a flow control insert fluidly coupled to the second and third flow lines.

16. The system of claim 10, wherein the one or more electronic components comprise one or more electronic controllers.

17. The system of claim 10, further comprising:

after reaching the second position:

aligning the tool string with a target operating position, wherein aligning the tool string comprises raising the tool string from the second position and into the region of the well; and while the tool string is aligned with the target operating position:

initiating performance of a downhole operation using the tool string, wherein initiating the performance of the downhole operation reduces a flow rate of the cooling flow, wherein the downhole operation comprises at least one of:

interrogating a geological formation proximate to the region of the well to obtain information usable to identify properties of the geological formation and/or materials positioned with the geological formation;

extraction of at least a portion of the materials positioned with the geological formation; or injection of another material into the geological formation;

during the performance of the downhole operation:

monitoring a temperature of at least the electronic components; and in an instance of the monitoring of the temperature where the temperature exceeds a threshold temperature:

modifying a flow rate of the cooling flow to manage the temperature of the at least the electronic components within temperature limits, the threshold temperature being based on the temperature limits, wherein the temperature limits are based on hardware components of the electronic components, the hardware components being subject to damage and/or undesired operation when exposed to temperatures outside of the temperature limits.

18. A non-transitory machine-readable medium having instructions stored therein, which when executed by a processor, cause operations for operating a tool string to be performed, the operations comprising:

while the tool string is being moved from a first position to a second position in a well:

circulating a cooling flow to the tool string using a supply line and an annulus of the well;

dividing, by a manifold within an interior of a body of the tool string, the cooling flow into a first sub-flow along a first flow line between the manifold and a first port, a second sub-flow along a second flow line between the manifold and a second port, and a third sub-flow along a third flow line between the manifold and a third port, wherein the first, second, and third flow lines are within the interior of the body, and the first, second, and third ports are in fluid communication with the annulus;

ejecting the first sub-flow out of the body of the tool string via the first port at a first location along the tool string to locally cool a region of the well;

directing the second sub-flow through the second flow line internally through a first portion of the tool string to the second port at a second location along the tool string to cool, at least, one or more electronic components within the interior of the body positioned in the first portion of the tool string; and ejecting the second sub-flow out of the body of the tool string via the second port at the second location along the tool string.

19. The medium of claim 18, wherein the operations further comprise directing the third sub-flow through the third flow line internally through a second portion of the tool string to the third port at a third location along the tool string to cool, at least, the one or more electronic components within the interior of the body positioned in the second portion of the tool string, wherein the second flow line extends a first axial distance from the manifold to the second port, wherein the third flow line extends a second axial distance from the manifold to the third port, and wherein the first and second axial distances axially overlap with one another in a downhole direction away from the manifold.

20. The medium of claim 18, wherein the operations further comprise:

adjusting flow of the second sub-flow via one or more first valves and a first pump along the second flow line;

adjusting flow of the third sub-flow via one or more second valves and a second pump along the third flow line;

isolating a portion of the well via a packer coupled to the body of the tool string about the second and third flow lines, wherein the packer is disposed axially between the first port at the first location and the second and third ports at the respective second location and a third location; and acquiring and storing one or more samples of material via one or more sample carrying modules coupled to at least the third flow line;

mixing flows between the second and third flow lines via a mixing module fluidly coupled to the second and third flow lines; and rerouting flows between the second and third flow lines via a flow control insert fluidly coupled to the second and third flow lines.

* * * * *